US008485921B2

(12) United States Patent
Ramirez

(10) Patent No.: US 8,485,921 B2
(45) Date of Patent: Jul. 16, 2013

(54) USES OF SPORT HAND COVERS IN THE SPORT OF GOLF

(76) Inventor: John Cuevas Ramirez, Redlands, CA (US)

( * ) Notice: Subject to any disclaimer, the term of this patent is extended or adjusted under 35 U.S.C. 154(b) by 0 days.

(21) Appl. No.: 13/373,373

(22) Filed: Nov. 14, 2011

(65) Prior Publication Data

US 2012/0084900 A1 Apr. 12, 2012

Related U.S. Application Data

(62) Division of application No. 12/322,060, filed on Jan. 29, 2009, now abandoned.

(51) Int. Cl.
*A63B 69/36* (2006.01)
*A41D 19/00* (2006.01)

(52) U.S. Cl.
USPC ..... 473/409; 2/161.1; 2/161.8; 473/205

(58) Field of Classification Search
USPC ..... 473/59, 61, 62, 202, 205, 206, 409; 2/16, 2/20, 21, 159, 161.1, 161.2, 161.3, 161.5, 2/161.6, 161.7, 161.8, 162, 163
See application file for complete search history.

(56) References Cited

U.S. PATENT DOCUMENTS

| | | | | |
|---|---|---|---|---|
| 1,483,595 | A * | 2/1924 | Read | 473/205 |
| 2,025,710 | A * | 12/1935 | Beemer | D2/617 |
| 4,103,362 | A * | 8/1978 | Blakeman | 2/161.1 |
| 5,528,772 | A * | 6/1996 | Cheek | 2/161.1 |
| 7,114,193 | B2 * | 10/2006 | Winningham | 2/163 |
| D553,301 | S * | 10/2007 | Van Buren | D29/117.1 |
| D583,104 | S * | 12/2008 | Stewart | D29/114 |
| D595,929 | S * | 7/2009 | Brown | D2/617 |
| 2004/0177430 | A1 * | 9/2004 | Gordon | 2/161.2 |
| 2009/0025120 | A1 * | 1/2009 | Vestling | 2/161.1 |

* cited by examiner

*Primary Examiner* — Nini Legesse

(57) ABSTRACT

According to the various features, characteristics, and embodiments of the present invention which will become apparent as the description thereof proceeds, the present invention provides partial hand covers and uses of said covers, intended to increase the overall performance in sports activities.

11 Claims, 1 Drawing Sheet

USES OF SPORT HAND COVERS IN THE SPORT OF GOLF

This application is a divisional application to 12/322,060, filed Jan. 29, 2009.

FIELD OF THE INVENTION

The present invention relates to sports apparatus and equipment, and uses thereof, used in playing the game of Golf. The present invention and its multi-sport embodiments enhance the overall performance in athletic tasks and/or execution during sports play, including practice.

BACKGROUND FO THE INVENTION

An important goal in playing sports in to win. Often that means proper play execution, good ball control, good grip and feel, and proper form in the sports fundamentals. Gloves and other types of hand covers are permitted in most sports. Many individuals use gloves to enhance, in some way, their competitive edge. Indeed, gloves have become so important that different types of gloves have been created for different sports. Even within a sport, different types of gloves have been invented to, among other things, maximize performance in specific tasks.

In football, for example, there are gloves that offensive and defensive Tackles can wear, that have thick padding around part of the hand. Offensive Receivers can purchase more expensive, all closed-finger, thin gloves to enhance their ability to catch and grip a football.

The use of gloves in football is so widespread that nearly every football player uses them, with the notable exception of football quarterbacks. You rarely see a quarterback wear gloves, even if just to keep warm. Most quarterbacks choose to play football without gloves. This is largely because prior art consists of generic full-fingered gloves which are uncomfortable and burdensome on a quarterback's dominant (throwing) hand, particularly on those fingers a quarterback places over the football laces. In addition, the full-fingered gloves prevent a quarterback to have any 'feel' of the ball.

Playing the position of quarterback without the help of gloves, however, can also be an inferior choice. The website Wikihow.com, provides a good description of the conventional way to hold and throw a football. "Throwing the football is simple. Put your non-throwing side foot in front of you. Have your Pinkie, Ring and Middle fingers around the laces with your Index [Forefinger] finger on the strap. Put the other hand up on the ball. Put the ball up by your ear. Twist your hips toward the front foot. Throw the ball at the receiver." Whereas, the fingers over the laces have a solid grip on the ball—primarily due to the football laces on the ball—the two fingers off the laces (forefinger and thumb) are virtually unsupported and therefore have a relatively weaker grip, creating a weak overall grip on the football.

This weak overall grip becomes more pronounced when added stress is placed on the Thumb or Forefinger. When a quarterback, intending to pass the football, for example, suddenly has to scramble, or if the quarterback 'pumps' the ball (goes through all the motions and speed of throwing the ball but doesn't actually release the ball), the grip strength of the Thumb and Forefinger can determine whether or not a quarterback fumbles the ball. Also, if one performs a simple test and wets his/her dominant hand, and then grabs and pumps a football, the forefinger and thumb will often move or slip. On a wet football field, during extreme weather conditions (hot or cold), that weaker or looser grip makes for a much more difficult completed pass, less success at throwing a spiral, and inconsistency and inaccuracy in passing.

Under the 'tips' section of Wikihow.com, it further describes proper football throwing form: "A proper throw will feel like it's only utilizing the Thumb, Index [Forefinger], and Middle finger. Good release will 'roll' off of your Index and Middle finger, to impart more spin; you may snap your wrist through as you follow through to the hip. The other three fingers on your hand stabilize the ball as its being flung. They should not be used to impart spin on the ball. The most important finger to throwing a spiral is the Index finger; it is the finger that holds the most leverage in putting spin on the ball."

In the field of Golf, to be sure, there exists much prior art in the form of hand covers for a golfer's weak (non-dominant) hand. In fact most active golf players wear a glove on their weak hand, and go without a glove for their strong hand (if one were to go to any major store to buy golf gloves, they would be sold and packaged in singles—one glove—not sold in pairs). Gloves are prevalent in golf largely because of the role that hand grip and control play in a golfer's overall performance.

Although there exist many types of full-fingered gloves for a golfer's weak-hand, they all attempt to maximize a golfer's weak-hand grip without regard to a golfer's weakhand feel, and hand coordination needs. It is no surprise, therefore, that prior art consists of full-fingered (all fingers are covered), closed palm (entire palm is essentially all covered) gloves. As a result, a typical golfer must rely on his/her weak-hand to provide most of the grip support, and on his strong-hand to provide all of the 'feel' in his golf swing. There is, therefore, an opportunity to invent a device—and improve prior art—that could offer some 'feel' ability for the weakhand, without significantly diminishing that enhanced grip ability that hand covers offer. This would increase overall hand control of a golfer's club swing, and therefore greater success in competition.

Whereas weak-hand support products seem to be crowded in the sport of Golf, there is a long existing need for a device that could offer added support for a golfer's stronghand without significantly diminishing its ability to adequately feel the golf club. Inventing a solution to this problem could, among other things, allow for greater golf swing control and consistency, and create an entirely new market because that would support a golfer's strong-hand.

In Golf magazine's April 2005 article titled "Fix your grip. The wrong grip can cripple your swing—Here's the cure", golf instructor Charlie King provides an overview of how to grip a golf club. "Good golf starts with your grip. The proper hold on the club helps you do three crucial things: Hinge your wrists, control the club face at impact and support the club throughout the swing. Here are three simple grip tips." As King continues, his third tip is "both hands; solid at the top. An effective grip sets the face square at the top, with the shaft parallel to the target line. You should feel most of the club's weight in your left Thumb and right Forefinger. Now you're ready to turn it loose." Although prior art seems to be crowded in offering a hand cover for the weak-hand, to support and better control the club weight placed on the Thumb of the weak-hand, there remains an unmet need for added support on or around the Forefinger of the strong-hand. Additionally, constant swinging of a golf club at real swing speeds often results in soreness on and between the Thumb and Forefinger of a golfer's strong hand (wearing no glove). This soreness can often also come from the rubbing or slipping, between the club handle and the strong-hand, suggesting a need to find a way to increase the grip of a golfer's strong hand. This is especially important in the sport of golf because even the smallest of slipping—during the golf swing or upon impact of the golf ball—can create enormous inconsistencies and inaccuracies, critical issues in determining overall performance.

Consequently, there are clear indications that an entirely new market exists for a device that could support a golfer's strong hand (not just a golfer's weak-hand). In particular there remains an unrecognized problem and an unmet need that would provide multiple benefits, such as better overall grip, more coordination with both hands, as well as some protection from any constant grip slipping, during the practice or play of golf, and in various other sports activities.

In the sport of Basketball, there is not prior art when it comes to hand covers to enhance performance, or even simply for aesthetic purposes, and/or that may be used during actual game play.

One clear hand task in basketball is in shooting the basketball with the intention of making a score or basket. Conventional jump-shot shooting form requires, among other things, that the player hold the basketball largely with the fingertips of both hands, and creating a small opening—or a shooter's gap—between the ball and the palm area of the player's strong-hand. No prior art exists that would assist an athlete in maintaining or learning to maintain this shooter's gap No prior art exists that would provide an athlete with the ability to have enhanced control when dribbling a basketball. A typical game—even a professional game—often can have as many as 30 turnovers (combined), so offering art that could increase ball control while dribbling, passing or even catching a basketball could significantly enhance performance by, among other things, minimizing turnovers. For example, minimizing turnovers by offering better ball control while dribbling a basketball would dramatically enhance player performance generally, including those players playing the position of Guard.

Although athletes playing the position of Forward or Center would also benefit by enhanced dribbling abilities, most of the turnovers caused by Forwards and Centers are often the result of dropping passes thrown to them, or from making a bad pass. Offering art that would enhance the ability to better pass or catch a basketball could therefore also enhance overall performance for anyone playing the sport of basketball.

DETAIL DESCRIPTIONS OF THE INVENTION

In general, the present invention can generally be used in conjunction with any type of sports play or practice.

One sport where said present invention will clearly enhance performance is in the sport of football. For example, one particular unmet need that this present invention will satisfy will be with football quarterbacks. In the book "Coaching Football Successfully," by Allan Trinkle (2001), "Quarterback mechanics and ball-handling skills are vital for offensive success and consistency." One embodiment of the present invention, comprising a glove that covers all of the Thumb and Forefinger, and none of the remaining fingers, will allow a quarterback to increase his ball grip and overall control of a football while allowing some finger feel of the football as well (see drawing FIG. 1).

This glove will take into account the benefits of the laces on a football and give a quarterback the unique ability to grasp a football over the football laces with the comfort and feel of not having a glove, while adding the support that a glove provides over the Thumb and Forefinger. Improvement in throwing accuracy and overall performance would result from this unique type of support provided by the new art.

Another embodiment could support a less popular, but still effective quarterback hand grip whereby only two fingers are over and grip the football laces, leaving the Thumb, Forefinger and Middle finger not touching the laces and therefore virtually unsupported. Thus this embodiment could comprise a glove that covers all of the Thumb, Forefinger and Middle finger, and leaving the portion of the fingers which are generally placed over the football laces, uncovered (See drawing FIG. 2).

In addition to offering greater throwing accuracy and consistency, these (and other embodiments) should also help minimize quarterback fumbles by adding support when 'pumping' the ball, scrambling from being tackled, and when catching and throwing the football when in 'shot gun' formation (when in shot gun formation especially, a quarterback must quickly look down field at his/her receivers and 'feel' for the football laces. The present invention would allow a quarterback to maintain a heightened sense of feel in his Ring and Pinkie Finger while increasing the grip support on his Thumb, Forefinger and Middle Finger). The features will, among other things, enhance grip and control while maintaining or even enhancing overall feel.

Another sport where the present invention will meet an unmet need is in the sport of Golf. First, some embodiments would improve prior art. Currently, only full-fingered gloves exist for golfers, regardless of one's preferred golf grip. Prior art therefore does not allow a golfer to take complete advantage of his/her preferred grip.

One very popular grip, for example, is called the interlocking grip. When you use this grip, the Forefinger of the golfer's weak-hand is placed over his strong-hand. With this grip, clearly the role of the weak-hand's Forefinger has less to do with grip and more with coordination and feel on the strong-hand, to more effectively control the golf swing and to provide greater golf swing consistency. There is, therefore, no real need to cover the weak-hand's Forefinger, and covering the Forefinger actually diminishes said Forefinger's sensitivities. Embodiments of the present invention would offer significant improvement to prior art.

One embodiment that would, among other things, improve prior art would comprise a glove that covers essentially of the weak-hands Thumb, Middle, Ring and Pinkie Fingers, while leaving the Forefinger completely uncovered. Although golfer's who use the "overlapping" golf grip might also find the above mentioned very useful, another embodiment might prove to enhance overall swing performance even more. This embodiment would comprise a glove covering essentially all of the weak-hand's Thumb, Forefinger, Ring and Pinkie Finger, while leaving the weak-hand's middle finger at least partly uncovered. This way, when the golfer, using the overlapping grip, places the Pinkie finger of his/her strong hand over and between the covered Forefinger and uncovered Middle finger of his weak-hand, the coordination from the added feel between the two hands will be enhanced (See Drawing FIG. 3, where the Middle Finger is uncovered in a manner so that the hand hand's Pinkie Finger could touch the skin of said Middle Finger, when said Pinkie Finger is placed on top of said Middle Finger. The other portions of FIG. 3 do not necessarily match the description mentioned above, however). Among the benefits of the present invention would be to offer greater golf consistency and accuracy by solving an unrecognized problem in prior art.

In addition to offering improvements to prior art, embodiments can also solve problems and offer new art, in the form of devices which could be tailored for a golfer's strong hand. Among the benefits of this new art would be better overall grip, better control and enhanced performance. One embodiment, for example, for a golfer's strong-hand comprises, a glove that covers essentially all of the stronghand's Thumb, Forefinger and Middle finger, leaving the Ring and Pinkie finger uncovered. The "feel" and coordination tasks could therefore be maintained with the Ring and Pinkie finger by leaving these fingers uncovered, while enhancing the overall grip of the strong-hand by covering the strong-hand's Thumb, Forefinger and middle finger.

By way of example, another sport where embodiments of the present invention would fulfill unmet needs would be in the sport of Basketball, and could be used during practice, warm-up and/or actual game play activities.

One embodiment that would help a player shoot better comprises a full-fingered glove—covering all five fingers of the strong-hand—while the palm area of said hand is largely uncovered. For all basketball players, but especially for those who cannot generally shoot a basketball very well, the open palm glove over the strong hand allows them to feel when they're shooting incorrectly (if the basketball touches the palm area, then there is no shooter's gap, and is therefore generally considered as using bad shooting form). This would especially be true when shooting a ball from the free-throw line or outside of the perimeter. Eventually, these athletes may not need this embodiment for shooting once they understand and learn to maintain their shooter's gap throughout the basketball shot. The open palm could also allow for some ventilation as well. The benefits of this glove include the ability to enhance the senses around the uncovered palm (relative to the other parts of the hand) so that the basketball player could more easily know when the basketball is touching the palm, generally indicating bad shooting form.

Embodiments could also satisfy a need a dribbling a basketball as well as. According to the book "Basketball for High School Players and Coaches," (1955) Carl Bachman describes proper fundamentals of basketball dribbling: "Certain fundamentals apply to all phases of ball handling: Looseness of finger and wrist action is important, practice spinning the ball on fingertips; a basketball should never touch the heel of the hand and seldom, if ever, touch the palm." One embodiment of the present invention could comprise a full-fingered, partially open palm (only the heel area) glove for either the strong-hand or the weak-hand. The glove might also extend through the wrist area, depending on how much of the heel is uncovered. This embodiment could help a dribbler develop and use proper dribbling form, especially on her weak-hand. This embodiment would more generally help any player, and likely could be used, for example, by those playing the position of Guard while practicing proper dribbling on their strong-hand, as well as Forwards and Centers during actual game play for added support on their weak-hand.

Many embodiments will help players slamdunk a basketball, often requiring the player to 'palm' the ball as well as when placing one's hands on the basketball rim. The present invention will provide added grip support and greater performance in slamdunking.

Another embodiment for basketball for basketball play is in the form of an all partially-open glove. All five fingers are only partially covered, perhaps up to about the first joint of each finger. Additionally, the palm area would also be largely uncovered. This embodiment would give a basketball player the ability to better catch a ball, thus eliminating the consistent problem often found in Forwards and Centers losing control of passes. The embodiment would also provide a player with a stronger grip on the ball when passing a ball as well as provide some moisture management control, thus minimizing turnovers often caused by passers, especially in Guards.

Although the description of the present invention only discussed three sports, it is understood that other sports might benefit as well (such as in baseball and volleyball). In addition, only some embodiments have been discussed and in no way is intended to limit all the various embodiments and other embodiments that the present invention provides, such as but not limited to, different designs. For example, embodiments can easily be developed for easy opening, where a part of the back of the hand opens Sup, using Velcro. Additionally, these embodiments can be used by men and women, boys and girls, as well as those that whose dominant hand is the right hand or the left.

BRIEF DESCRIPTIONS OF THE DRAWING

It is expressly understood that the following descriptions and drawing are for illustration purposes only, and in no way are intended to limit the scope of the present invention and its various embodiments. For example, the drawings are of drawings of embodiments for the left hand but can easily be created for the right hand, and can be used by men and women, boy and girls.

DETAILED DESCRIPTION OF THE DRAWINGS

It is expressly understood that the drawings are for the purpose of illustration and description only and are not intended as a definition of the limits of the invention.

Figure 1:
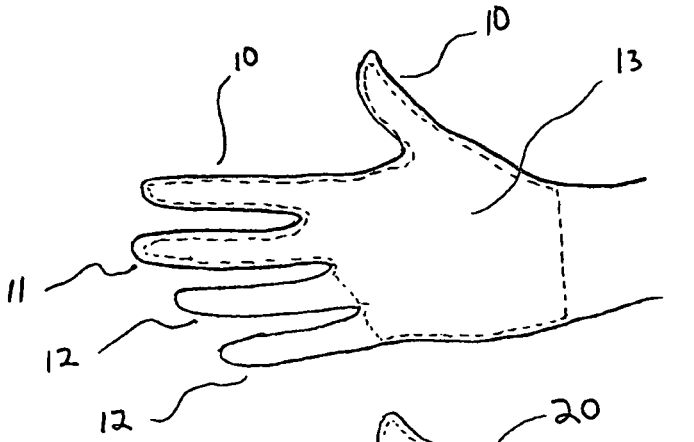
FIG. 1 is a drawing of an embodiment for the left hand, as claimed in claim 1 as well as claim 4.

In FIG. 1, the present invention, under claim 1, is shown as a partial-fingered glove. This particular glove could be made of cabretta leather to offer moisture and perspiration resistance. The Thumb and Forefingers 10 are entirely covered by the glove. The Middle Finger 11 is also entirely covered. The Ring and Pinkie Fingers 12 are both entirely uncovered. The rest of the hand, including the Palm area 13, are covered by the glove.

Figure 2:
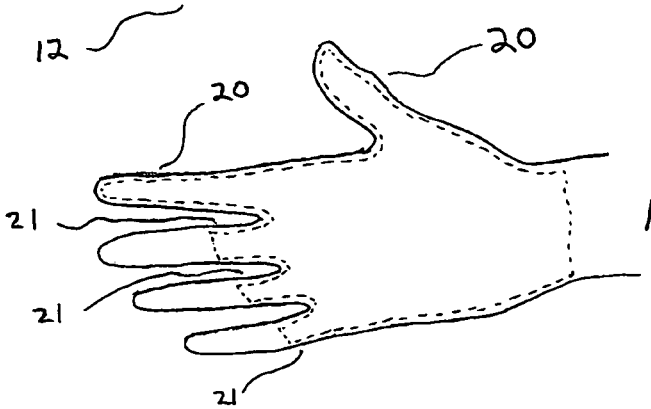
FIG. 2 is a drawing of an embodiment for the left hand, as claimed in claim 1.

In FIG. 2, the present invention, also under claim 1, is shown as a partial-fingered glove. This particular glove can be made of polyester and cotton for superior comfort. The Thumb and Forefingers 20 are entirely covered, and can have PVC dots throughout said fingers (not shown) to further enhance grip, if one so desires. The Middle, Ring and Pinkie Fingers 21 are all partially covered, about one-third the way up the fingers, to about the first knuckle.

Figure 3:
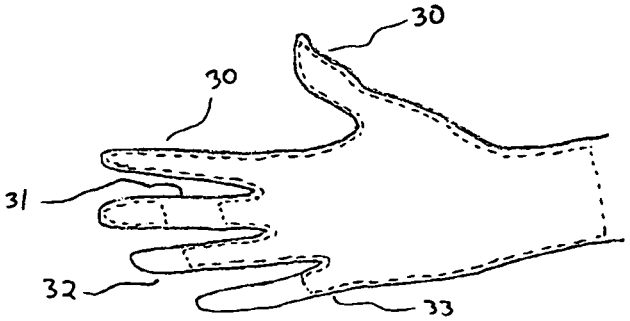
FIG. 3 is a drawing of an embodiment on the left hand.

In FIG. 3, the present invention, is shown as a partial-fingered glove. The Thumb and Forefingers are entirely covered 30. The Middle Finger is partially uncovered. Specifically, the top (outside) portion of most of the Middle Finger's first joint and second joint, or the dorsal surface of the middle finger segment overlaying and between the distal interphalangeal joint and the proximal interphalangeal joint, is uncovered 31. The Ring Finger is largely covered, except for the third joint, or the distal phalanx of the digital segment overlaying said ring finger, which is entirely uncovered 32. The Pinkie Finger is largely uncovered, except for part of the first joint, or the proximal phalanx of the digital segment overlaying said pinkie finger, which remains covered 33. The small opening on the Middle Finger will allow the skin of said finger to make contact with the skin of another finger. For example, a golfer who grips a club using the overlapping grip could wear this embodiment on his/her weak-hand. The golfer would then place his dominant-hand's Pinkie Finger on top of and between his/her weak-hand's covered Forefinger and Middle Fingers. However, this embodiment would allow the skin of the weak-hand's Middle Finger to touch the skin of the dominant-hand's Pinkie Finger, thus increasing hand coordination. As best seen by the drawing, the rest of the hand is covered by the glove.

What is claimed is:

1. A method of gripping a golf club, comprising the following steps: a. Providing a sport means comprising a partially open hand cover, where said cover is a glove having connected back and palmar portions for protecting respective back and palmar areas of the human hand, the back and palmar portions having distal and proximal ends with a plurality of digital segments projecting from the distal ends, where the digital segment of the thumb overlays the entire thumb including the fingertip of said thumb, where the digital segment of the forefinger overlays the entire forefinger including the fingertip of said forefinger, where the digital segment of the middle finger overlays the entire middle finger including the fingertip of said middle finger, said middle finger also comprises an aperture along the digital segment of the middle finger leaving at least a portion of the proximal phalangeal bone of said middle finger, uncovered, and leaving at least one of the remaining two fingers at least partially covered; b. Placing said hand cover on the hand; c. Gripping the golf club using both hands.

2. The method of claim 1, wherein the glove is placed on the dominant hand; and, wherein the Pinkie Finger of the hand cover placed on the dominant hand, is essentially completely uncovered.

3. The method of claim 1, wherein an individual grips said golf club by the Interlocking Grip Method.

4. The method of claim 1, wherein an individual grips said golf club by the Overlapping Grip Method.

5. The method of claim 1, wherein said aperture on the digital segment overlaying the proximal phalangeal bone of the middle finger is only located on the side of said phalangeal bone nearest the forefinger segment, and/or on the dorsal surface of said phalangeal bone, such that a user gripping a golf club can touch the skin of said middle finger with the skin of the Pinkie finger's dominant hand.

6. The method of claim 1, wherein the uncovered portion of the digital segment overlaying the proximal phalangeal bone of the middle finger further comprises an aperture on the palmar area of said middle finger, such that a user gripping a golf club can touch the skin of said middle finger with the golf club.

7. The method of claim 1, wherein said sports means comprising the digital segment overlaying the proximal phalangeal bone of the middle finger is uncovered, said uncovered area creating an aperture located along at least a portion of the palmar portion area of said middle finger.

8. The method as claimed in claim 1, wherein the digital segment of the middle finger leaves at least a portion of the middle finger uncovered, the digital segment of the Ring finger leaves the distal phalangeal joint uncovered through the fingertip of said Ring finger, the digital segment of the Pinkie finger leaves the middle phalangeal bone uncovered through the fingertip of said Pinkie finger.

9. The method as claimed in claim 1, wherein the pinkie finger of said glove is completely uncovered, the ring finger is thereby at least partly covered.

10. The method as claimed in claim 1, wherein the ring finger segment and the pinkie finger segment of said glove enclose the entire ring finger and pinkie finger, respectively.

11. The method as claimed in claim 1, wherein the digital segment of the Ring finger leaves only the distal phalangeal joint uncovered through the fingertip of said Ring finger, the digital segment of the Pinkie finger overlays only the proximal phalanx of said Pinkie finger, in part or in its entirety.

* * * * *